United States Patent [19]

Huerta et al.

[11] Patent Number: 4,511,135

[45] Date of Patent: Apr. 16, 1985

[54] ENHANCED ENVELOPE FEEDING

[75] Inventors: Jose L. Huerta, Austin; Roy A. Rachui, Georgetown; James E. Roberts; Grainger I. Simpson, Jr., both of Austin, all of Tex.

[73] Assignee: International Business Machines Corporation, Armonk, N.Y.

[21] Appl. No.: 452,992

[22] Filed: Dec. 27, 1982

[51] Int. Cl.[3] ..... B65H 1/08

[52] U.S. Cl. ..... 271/126; 271/8.1; 271/119; 271/149; 271/161; 414/330

[58] Field of Search ..... 271/126, 127, 119, 8 A, 271/148, 149, 160, 161, 171, 167, 169, 37, 38, 30 A, 129, 150; 221/231, 260, 279; 414/330

[56] References Cited

U.S. PATENT DOCUMENTS

| | | | |
|---|---|---|---|
| 3,570,845 | 3/1971 | Kellerman | 271/160 |
| 3,572,691 | 3/1971 | Heinricy | 271/23 |
| 4,078,672 | 3/1978 | Crepaldi et al. | 214/8.5 A |
| 4,151,987 | 5/1979 | Toriumi et al. | 271/160 |
| 4,371,157 | 2/1983 | Hunt et al. | 271/2 |

FOREIGN PATENT DOCUMENTS

| | | | |
|---|---|---|---|
| 3047278 | 7/1982 | Fed. Rep. of Germany | 271/8 A |

OTHER PUBLICATIONS

Office System 6 General Information Manual for IBM Information Processors; pp. 10 and 14.

*Primary Examiner*—Bruce H. Stoner, Jr.
*Assistant Examiner*—John A. Carroll
*Attorney, Agent, or Firm*—Andrea P. Bryant

[57] ABSTRACT

A modular envelope feed mechanism which may be used with a cut sheet feeder attachment for high speed printers or the like is disclosed. Envelopes are more reliably fed and separated because they are urged toward a pair of separators at the separation station with uniform force by a pressure plate containing a pivotable member provided with resilient pads positioned in alignment with the separators.

10 Claims, 5 Drawing Figures

FIG. 3
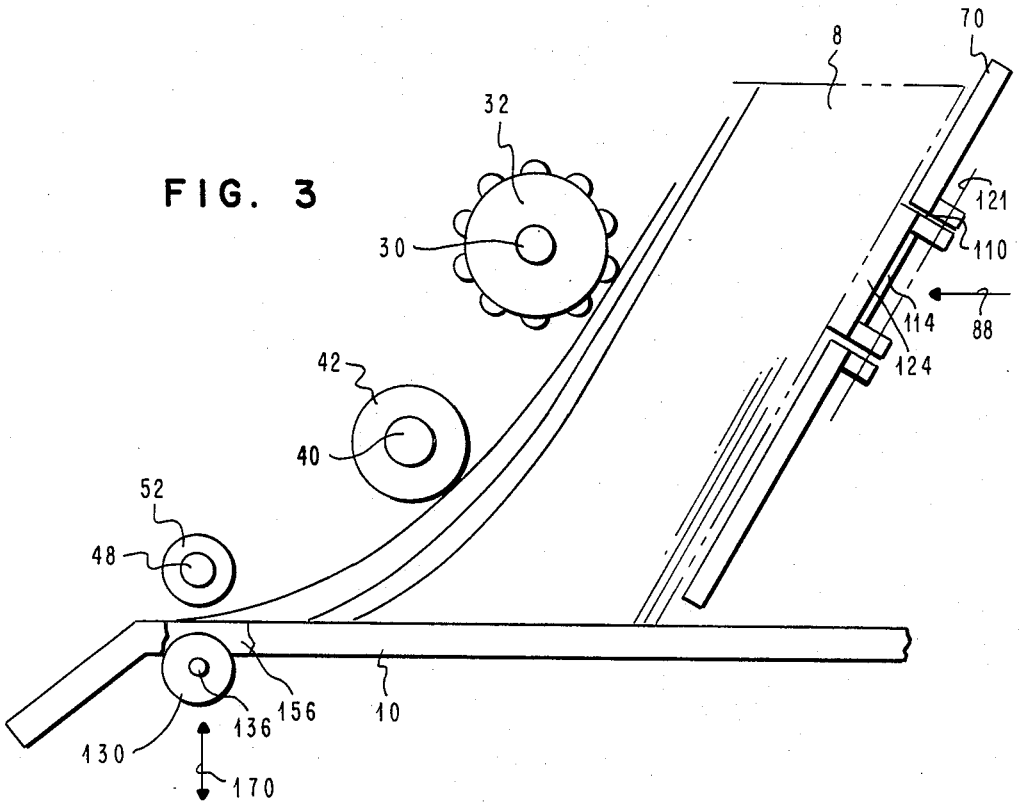
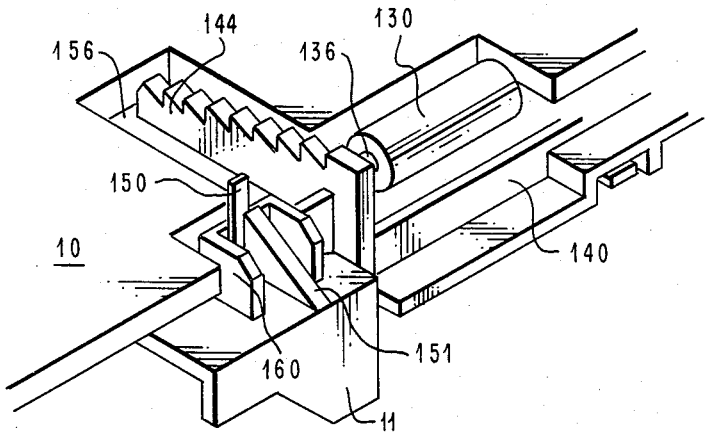
FIG. 4

ENHANCED ENVELOPE FEEDING

CROSS-REFERENCE TO RELATED APPLICATION

U.S. patent application Ser. No. 453,023, filed concurrently herewith, having J. L. Huerta as inventor and commonly assigned.

DESCRIPTION

1. Technical Field

This invention relates to document feeding to high speed printers or the like more particularly it relates to improved apparatus for feeding envelopes to a high speed printer.

2. Background Art

Envelope handling apparatus is known in the prior art. The IBM 6640 Document Printer, for example, in addition to cut sheet feed and delivery includes an envelope handler capability. Another technique for handling envelopes in addition to cut sheets is taught in copending commonly assigned U.S. patent application Ser. No. 219,684 filed Dec. 24, 1980 having R. E. Hunt et al as inventors. Hoppers having a rear wall urged toward the document separation station are known, for example, U.S. Pat. No. 3,572,691.

U.S. Pat. No. 4,078,672 to Crepaldi et al teaches a slanted support urging items to be fed to the feed station. The angle of inclination is stated to be between 105° and 110° from the base of the feed tray.

DISCLOSURE OF THE INVENTION

Envelope feeding using the present invention is particularly enhanced as a result of the improved spring biased pressure plate. The pressure plate is used as the movable rear wall of the hopper and is urged forward as the envelope stack decreases in size. The pressure plate includes a pivotable plate portion with pads of resilient material. The pressure plate assembly is slanted at an angle 125° from the horizontal, measured from the feed station toward the rear of the hopper. This slant causes the envelope stack to be presented at the picking station in a pre-shingled state. The frontmost envelopes are shingled using roll wave picker separators and, after being properly aligned, are fed to the print station.

BRIEF DESCRIPTION OF THE DRAWINGS

Referring now to the drawings wherein a preferred embodiment of the invention is illustrated, and where in like reference numerals are used throughout to designate like parts:

FIG. 3 is a partial cross-sectional view of the envelope feed station.

FIG. 4 is a close-up view of one side of the alignment-/restraining station.

DESCRIPTION OF THE PREFERRED EMBODIMENT

Figure 1:
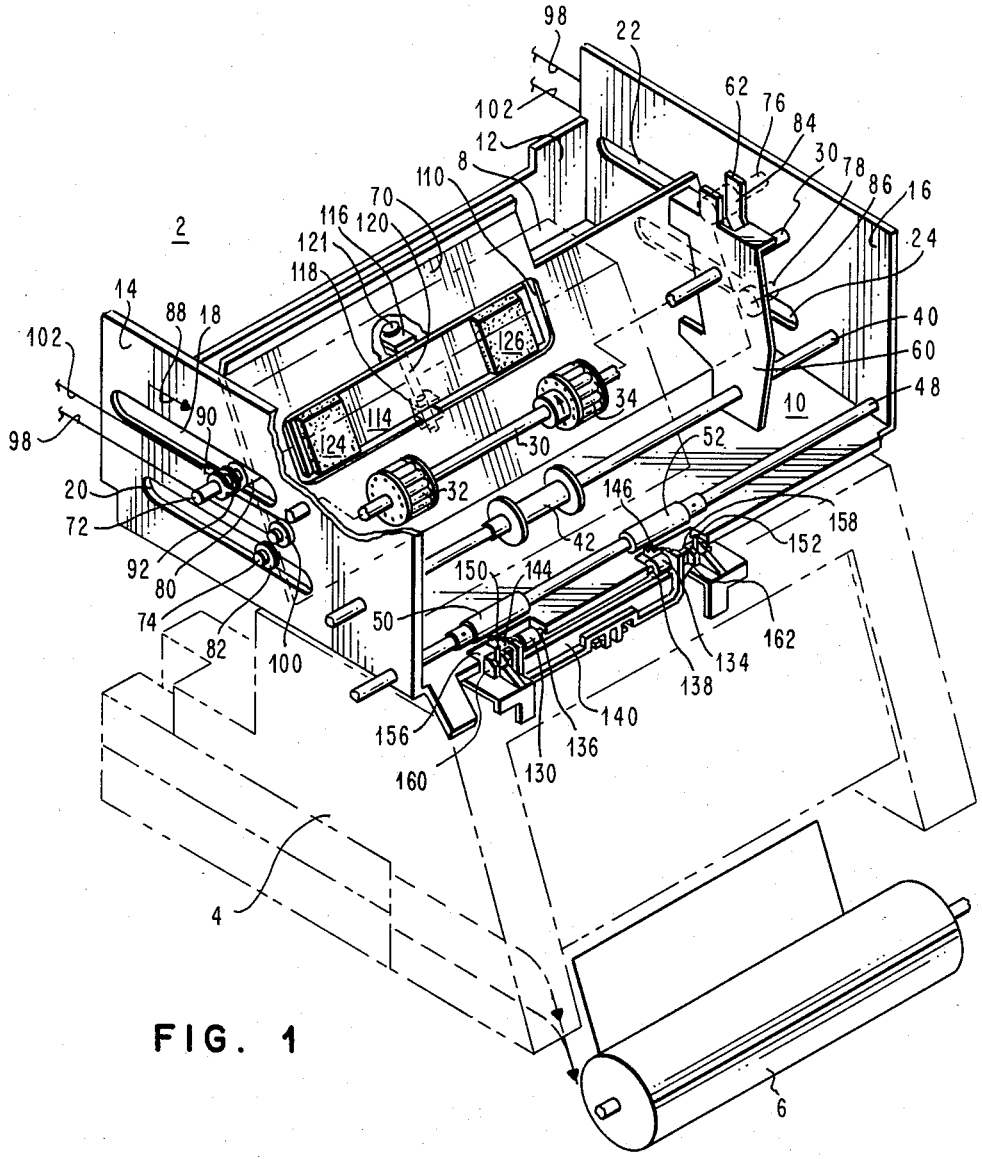
FIG. 1 is a perspective view of the envelope handling apparatus of the present invention.

Refer now to FIG. 1. The envelope handling device of the present invention is indicated generally at 2, placed on top of a cut sheet handler indicated in phantom at 4 so that each may supply documents to a common path to platen 6 of the printer, not shown.

Envelope device 2 includes a hopper holding a stack 8 of envelopes comprised of base 10, fixed rear wall 12 and slotted side walls 14 and 16. Side wall 14 has slots 18 and 20 for purposes which will become clear as the description proceeds. Similarly, side wall 16 has parallel slots 22 and 24 which are aligned with those in side wall 14. Shaft 30 is rotatably mounted in side walls 14 and 16. Fixedly mounted on shaft 30 for rotation therewith are shingler rollers 32 and 34 of the ferris wheel type. A DC motor (not shown) is provided for driving shaft 30.

Also mounted across envelope handling device 2 in side walls 14 and 16 is rod 40. Rotatably secured to rod 40 is idler roller 42. Roller 42 is provided for constraining envelope stack 8 and enhances the concavity of the foremost envelope in the stack when it is being shingled forward. A shaft 48 is rotatably mounted downstream of rod 40 in side walls 14 and 16. Feed rollers 52 and 54, fixedly mounted on shaft 48, are driven through belt and pulley linkage (not shown) by platen 6.

The actual size of the envelope storage area within envelope handling device 2 is adjustable in accordance with the width and depth of the envelope stack 8 to be fed. Storage area width is adjustable by means of side guide 60. Lever 62 which is provided for releasing and locking the position of side guide 60 will be discussed in detail having reference to FIG. 3. Side guide 60 is slidably mounted on shaft 30 and rod 40.

Self-adjusting, movable pressure plate 70 which supports the rear of stack 8 is inclined at 55° C. to the horizontal base 10, measured from the direction of rear wall 12, of envelope handling device 2. This position enhances the separation of the foremost envelopes prior to the beginning of the mechanical separation cycle because some of the envelopes are already separated. Maintaining stack 8 at such an angle also magnifies the action of separation by providing more discrimination between the first and second envelope.

Pressure plate 70 includes four studs, two on either side, 72 and 74 on the left and 76 and 78 on the right, upon which are mounted four rollers having soft rolling surfaces. Rollers 80 and 82 are on studs 72 and 74; rollers 84 and 86, on studs 76 and 78. Studs 72, 74, 76 and 78 extend through the four parallel slots, 18, 20, 22 and 24, located in envelope device side walls 14 and 16, respectively.

Each of studs 72 and 76 is additionally provided with two cable connector clips for anchoring cables used to control the position of pressure plate 70 as it is urged in the direction of arrow 88. Stud 72 has clips 90 and 92 while stud 76 has attached thereto clips 94 and 96. Cable 98 is connected to clips 92 and 94 over pulley 100 mounted on side wall 14. Cable 102 is connected to clips 90 and 96 over pulley 104 mounted on side wall 16. Cables 98 and 102 are trained over a system of pulleys, which with appropriate spring means are provided for urging pressure plate 70 toward separator shingler rollers 32 and 34. This structure will be described having reference to FIG. 2.

Pressure plate 70 includes an opening 110, corresponding in size and shape, for accommodating pivot plate 114 which is pivotally mounted by means of brackets 116 and 118 to pressure plate 70. Pivot plate 114 moves about an axis 121 through the center of rod 120. Opening 110 and pivot plate 114 located therein are positioned within pressure plate 70 so as to align pivot plate 114 with separator shingler rollers 32 and 34. In particular, resilient pads 124 and 126, located at either end of pivot plate 114, are aligned with shingler rollers 32 and 34, respectively.

Positioned directly beneath feed rollers 52 and 54 are back-up rollers 130 and 134. Back-up rollers 130 and 134 are rotatably mounted on studs 136 and 138, respectively, located at either end of bracket 140. Made integral with bracket 140, at either end thereof adjacent back-up rollers 130 and 134, are two sawtooth restraint edges 144 and 146.

Figure 5:
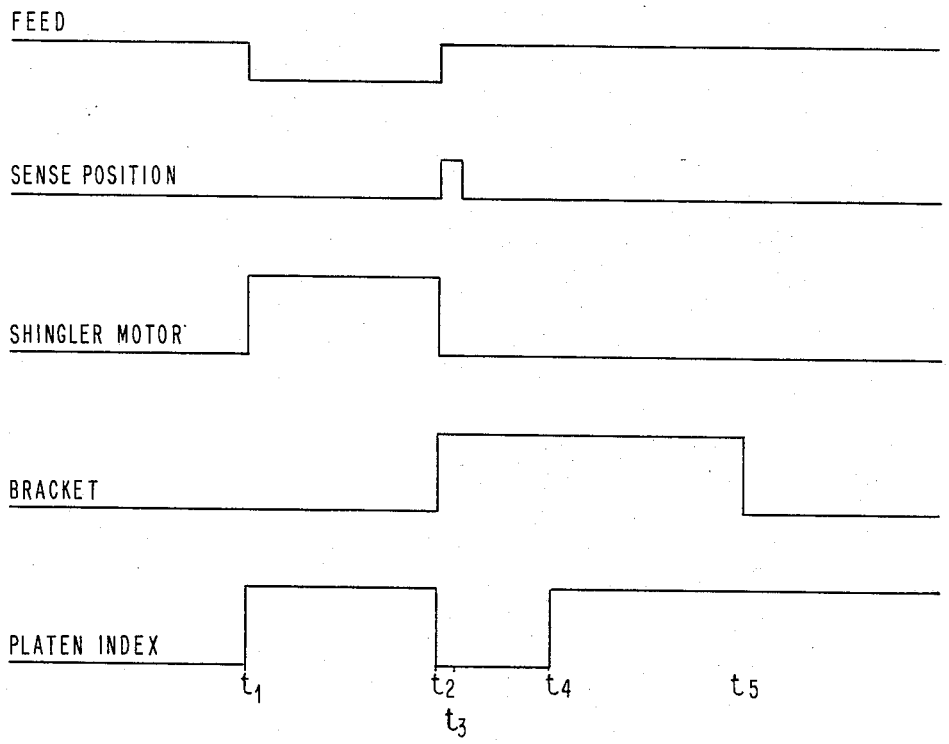
FIG. 5 is a timing chart.

Two micro-switches 150 and 152 for aligning and sensing the leading edge of an envelope from stack 8 are provided in appropriately shaped openings 156 and 158 in base 10. Openings 156 and 158 accommodate the micro-switches 150 and 152 which perform a dual function which will be described in greater detail having reference to FIG. 5, as well as sawtooth restraining edges 144 and 146, and back-up rollers 130 and 134. The entire restraint alignment function which occurs in the envelope path at a position beneath feed rollers 52 and 54 is more fully described and claimed in co-pending, commonly assigned, U.S. patent application Ser. No. 453,023.

Figure 2:
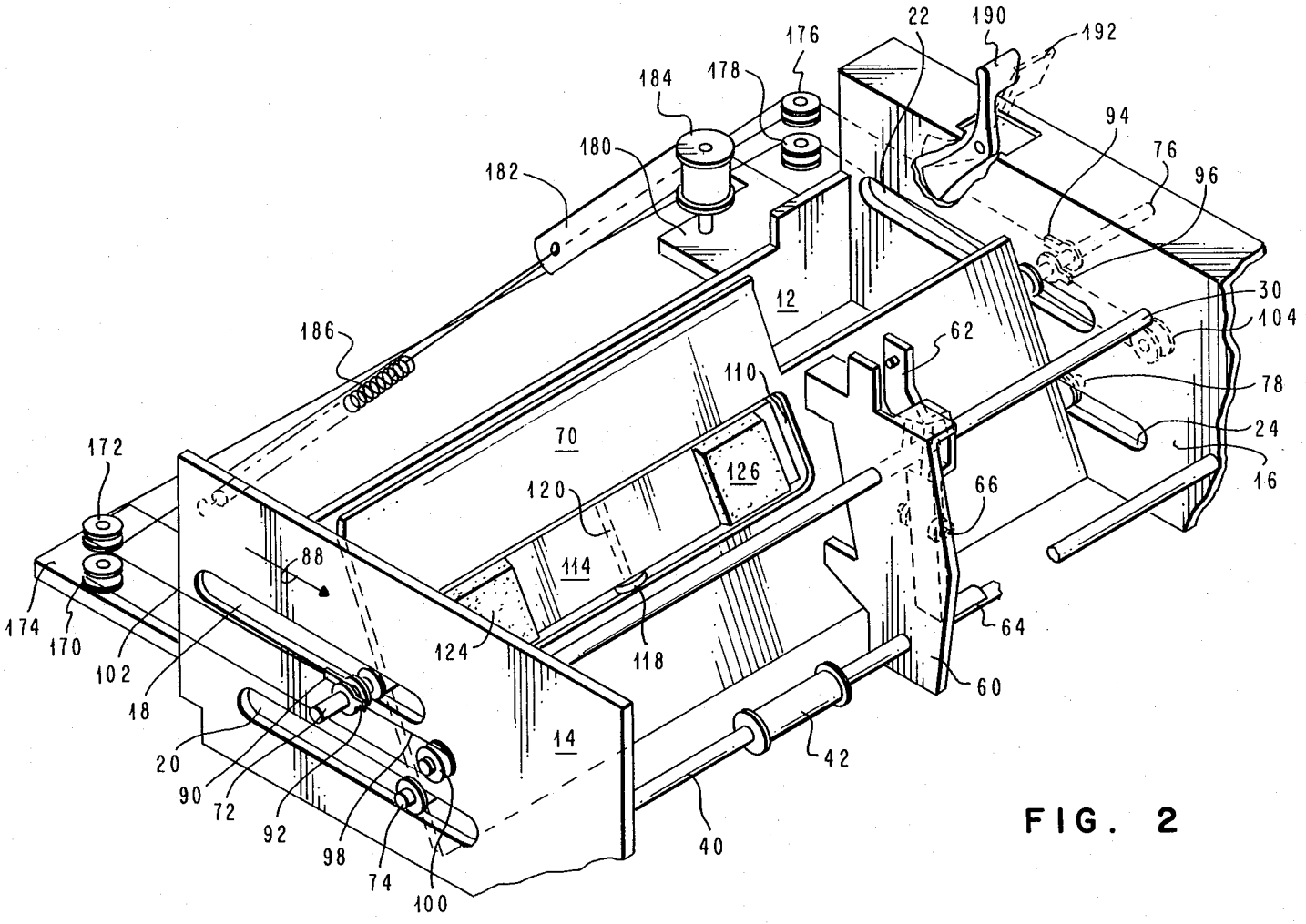
FIG. 2 is a more detailed view of the means for controlling pressure plate 70 (FIG. 1) position.

FIG. 2 shows in more detail how pressure plate 70 is urged toward the envelope separation station with a non-skewed, bind-free, parallel motion. As above noted, stud 72 is provided with clips 90 and 92. Likewise, stud 76 has clips 94 and 96 attached. The system of pulleys over which cables 98 and 102 are trained additionally includes pulleys 170 and 172 mounted to member 174 and pulleys 176 and 178 mounted to member 180. Members 174 and 180 are connected to side walls 14 and 16, respectively.

Cable 98 is attached in parallel to a constant force spring 182, wound on spool 184, and to an extension spring 186. The other end of spring 186 is attached to side wall 14. The load of the constant force spring 182 is much greater than that of the extension spring 186. The load of pressure plate 70 is permitted to decrease as plate 70 moves toward separator shingle wheels 32 and 34 so that there is a substantially constant load between the separator rollers and stack 8 of envelopes.

The entire pressure plate 70 is urged toward the separator rollers because of the equal force exerted in studs 72 and 76 by the cable/pulley spring system just described. Since separator rollers 32 and 34 are not centered with respect to pressure plate 70, the force exerted against the separator rollers would not be equal. Pivotable plate 114 overcomes this problem. The forward urging force exerted on pressure plate 70 is transmitted through the pivot rod 120 centered in plate 114. In this way, resilient pads 124 and 126 urge envelope stack 8 with substantially equal force against separator rollers 32 and 34, respectively.

Locking lever 190 is provided to latch pressure plate 70 in its rearmost position. Stud 76 also serves as a detent member for cooperation with locking lever 190. The position shown at 190 is the locked position when pressure plate 70 is in its rearmost position. When pressure plate 70 is moved rearwardly, stud 76 momentarily cams lever 190 into the position shown in phantom at 192 to bring stud 76 under locking lever 190. The pressure plate is released by moving lever 190 into position 192 momentarily.

FIG. 2 also shows in more detail the adjustable side restraint 60 for envelope stack 8 (FIG. 1). Side plate 60 is slidably mounted on shaft 30 and rod 40. Lever 62 is provided to lock side plate 60 in a given location corresponding to a particular envelope width. Lever 62 is slidably mounted on shaft 30 and is pivotable about point 66 so that when the top of lever 62 is pinched leftwardly, the bottom portion 64 is released from engagement with the roughened surface of rod 40. Lever 62 has integral fingers that spring load the top of the lever to the right to provide the locking action.

Reliable separation and feed of envelopes in a stack 8 (FIG. 1) is enhanced by the improved pressure plate of the present invention, as will be apparent from the description of FIG. 4. FIG. 3 is a cross-sectional view through envelope apparatus 2 of FIG. 1. As pressure plate 70 is urged toward the separator shingle roller 32 in the direction of arrow 88, resilient pad 124 is illustrated in alignment with separator roller 32. The foremost envelopes in stack 8 have been shingled in the view. When the foremost envelope reaches the mid point of feed roller 52, it comes in contact with and actuates micro-switch lever 150 and closes the switch (FIGS. 1 and 4). At that point in the feed cycle, bracket 140 (FIGS. 1 and 4) having stud 136 with back-up roller 130 attached thereto moves in the upward direction of arrow 170 to clamp the foremost envelope between feed roller 52 and its back-up 130. The idler roller 42 on rod 40 functions to constrain envelope stack 8 and helps give the foremost envelope the concave form it assumes as it is shingled by shingler/separator roller 32.

FIG. 4 is a close-up view of the side of the alignment restraint station beneath feed roller 50 in FIG. 1. Bracket 140 is a unitary structure including the studs holding back-up rollers 130 and 134 (seen in FIG. 1) and at either end the sawtooth restraint edges 144 and 146 (seen in FIG. 1) and envelope lifter portions 160 and 162 (seen in FIG. 1). Means, not shown, are provided for lifting bracket 140 and its associated portions just mentioned above the plane of hopper base 10 so that once an envelope separated from stack 8 (FIGS. 1 and 3) makes micro-switch 150 and its corresponding switch at the other end (shown in FIG. 1) the bracket 140 is raised so that lifter portion 160 enables the envelope to be fed over the projecting lever 150 of the micro-switch.

The operating environment of the present invention may be readily understood in connection with the following description. The timing diagram of an envelope feed cycle will be described having reference to FIG. 5. At time t1 a using system feed signal request goes down. Simultaneously, a voltage for energizing the motor to drive shaft 30 with which the shingler separator wheels rotate goes up. The index signal for platen 6 of the using printer turns on platen index at the same time. The shingler motor voltage goes down when the envelope handler of the present invention senses that an envelope is properly aligned at the sense position and feed station, that is the point in time when sensor micro-switches 150 and 152 so indicate. At the same point in time, t2, the signal to raise bracket 140 having back-up rollers 130 and 134 attached thereto occurs. After a short delay, the sense position signal goes down at time t3. Following a delay of about 400 miliseconds, at time t4, the platen index signal comes up to line feed rollers 52 and 54 to transport an envelope through the feed station. The second delay is necessitated to allow bracket 140 to complete its upward travel into the feed path. At time t5 the signal for raising bracket 14 containing back-up rollers 130 and 134 goes down. The interval between time t4 and t5 is chosen to allow an envelope to completely clear the feed station of the apparatus of the invention and to enter the transport path of the using printer.

The present invention provides an envelope handling capability for use with high speed printers such as those used in word processing systems or the like. While with appropriate modifications, the device of the invention may be used directly with the printer, it is illustrated as being used in conjunction with a cut sheet handling device connected to the printer so that the user may avoid switching document handling devices in the midst of a job.

While the invention has been particularly shown and described with reference to a preferred embodiment, it will be understood by those skilled in the art that the abovementioned modification and various other changes in form and detail may be made without departing from the spirit and scope of the invention.

We claim:

1. In a hopper for holding envelopes on edge for separation for subsequent feeding to a printer or the like wherein the hopper comprises a base, two side walls and a moveable rear wall for urging the envelopes forward to separation station, said moveable wall being as wide as the distance between the two side walls, the width of the moveable wall being greater than the envelopes to be fed and the separation station being located off center of said moveable rear wall, the improvement comprising:

a separately moveable portion in said moveable rear wall;

said moveable portion being located in a correspondingly shaped opening in said rear wall;

said separately moveable portion being pivotable about an axis transverse to the direction of movement of the moveable rear wall;

said separately moveable plate including a pair of resilient pads positioned to align with the separating means toward which the envelopes are urged by the moveable rear wall.

2. The hopper of claim 1 wherein said rear wall is inclined rearwardly at an angle from the vertical so as to maintain the stack slanted substantially 125° from the base of the hopper.

3. In an adjustably sized hopper for holding on edge a stack of documents to be separated at a separation station for seriatim feeding to a using station, said adjustably sized hopper including a base, left and right side walls, said separation station comprising a plurality of separator rollers on a shaft at a location off center between the left and right side walls, improved apparatus for urging the documents to the separation station with substantially uniform force comprising:

a resiliently biased pressure plate for urging documents to the separation station;

a generally rectangular pivotable plate located in a correspondingly shaped opening in said pressure plate;

said pivotable plate being pivotable about an axis transverse to the direction in which the pressure plate moves; and a plurality of resilient pads on said pivotable plate, each of said resilient pads being positioned to be in alignment with one of the plurality of separator rollers.

4. The apparatus of claim 3 wherein:

the plurality of resilient pads on the pivotable plate is two, one located at each end.

5. The apparatus of claim 3 wherein:

the generally rectangular pivotal plate has its longer axis parallel to the base of the hopper between the left and right side walls.

6. The apparatus of claims 3, 4 or 5 including means for inclining said pressure plate at an obtuse angle with the base of said hopper.

7. Improved apparatus for separating documents prior to feeding to an operating station comprising, in combination:

input hopper means for holding a stack of documents on edge, upstream of the operating station, said input hopper including a base, two slotted side walls, a moveable rear support having projections configured to fit into the slots of the side walls so that the moveable wall may be urged forward as the size of the stack decreases;

means for urging the rear support forward;

a plate mounted in a correspondingly sized opening in the moveable rear support, said plate being substantially parallel with the plane of the rear support, and said plate being mounted to pivot about its center within the opening in the moveable rear support;

said plate in addition including raised pad portions adapted to contact the rear of the document stack;

means for separating the stack of documents, said means for separating including a plurality of rollers mounted on a shaft parallel with said moveable rear support, said rollers being located on such shaft so as to be in alignment with the raised pads on the pivotable plate;

whereby documents to be fed are urged with equal forces by the raised pads on the pivotable plate against each of the plurality of separator rollers.

8. The apparatus of claim 7 wherein the document stack is located assymetrically to one side of the moveable rear wall.

9. The apparatus of claim 7 or 8 wherein said rear support is slanted rearwardly from the vertical.

10. The apparatus of claim 9 wherein the rear support makes an angle of substantially 35° from the vertical.

* * * * *